US006457539B1

(12) United States Patent
Skinner

(10) Patent No.: US 6,457,539 B1
(45) Date of Patent: Oct. 1, 2002

(54) EARLY FORMATION EVALUATION TOOL

(75) Inventor: Neal G. Skinner, Lewisville, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/982,727

(22) Filed: Oct. 18, 2001

Related U.S. Application Data

(62) Division of application No. 09/490,334, filed on Jan. 24, 2000, now Pat. No. 6,340,062.

(51) Int. Cl.[7] ..... E21B 49/00
(52) U.S. Cl. ..... 175/58; 166/187
(58) Field of Search ..... 166/250.06, 250.07, 166/250.08, 250.17, 187, 191; 175/40, 48, 50, 230, 59; 73/152.22, 152.36, 152.38, 152.51, 152.52, 152.55, 152.57

(56) References Cited

U.S. PATENT DOCUMENTS 4,893,505 A 1/1990 Marsden et al.
5,473,939 A 12/1995 Leder et al.
5,540,280 A * 7/1996 Schultz et al. ..... 166/250.07
5,741,962 A * 4/1998 Birchak et al. ..... 72/152.16
5,770,798 A 6/1998 Georgi et al.
5,785,131 A 7/1998 Gray
5,791,414 A 8/1998 Skinner et al.
5,799,733 A 9/1998 Ringgenberg et al.
5,813,460 A 9/1998 Ringgenberg et al.
5,890,542 A 4/1999 Ringgenberg
6,065,355 A 5/2000 Schultz
6,189,612 B1 * 2/2001 Ward ..... 166/250.07
6,296,056 B1 * 10/2001 Ward ..... 166/250.07
6,330,913 B1 * 12/2001 Langseth et al. ..... 166/250.07

* cited by examiner

*Primary Examiner*—Robert E. Pezzuto
(74) *Attorney, Agent, or Firm*—Paul I. Herman; J. Richard Konneker

(57) ABSTRACT

An early formation evaluation tool is provided which includes formation fluid sampling capabilities. In one embodiment, fluid pressure in a drill string in which the tool is interconnected is utilized to operate packers of the tool and to operate fluid samplers of the tool. To successively control actuation of the samplers, a ratchet mechanism responsive to altering fluid pressures in the drill string aligns a piercing member with a series of frangible pressure barriers associated with the samplers.

26 Claims, 15 Drawing Sheets

EARLY FORMATION EVALUATION TOOL

CROSS-REFERENCE TO RELATED APPLICATION

This application is a division of copending U.S. application Ser. No. 09/490,334, filed on Jan. 24, 2000 and entitled "EARLY FORMATION EVALUATION TOOL", now U.S. Pat. No. 6,340,062, such copending application being hereby incorporated by reference herein in its entirety.

BACKGROUND OF THE INVENTION

The present invention relates generally to tools utilized in conjunction with subterranean wells and, in an embodiment described herein, more particularly provides an early formation evaluation tool having formation fluid sampling capability.

It is well known that it is desirable to have the capability of evaluating characteristics of formations intersected by a wellbore before drilling operations are completed. This type of formation evaluation is known as "early" formation evaluation by those skilled in the art. For this purpose, tools have been developed which are interconnected in drill strings, and which are capable of performing tests on formations, such as pressure draw down and buildup tests. These tests may be performed periodically during drilling operations.

However, it would also be advantageous to be able to collect samples of fluid from formations intersected by a wellbore during a drilling operation. Furthermore, it would be desirable to be able to collect such samples in conjunction with tests performed on formations, since this would be more economical and convenient than performing the formation tests and sample collections at different times, with separate tools, or on separate trips into the wellbore. Performing a formation test and a sample collection without moving the drill string between these operations would also aid in correlating the results of these operations to a particular location in the formation.

From the foregoing, it can be seen that it would be quite desirable to provide an early formation evaluation tool with the capability of collecting formation fluid samples.

SUMMARY OF THE INVENTION

In carrying out the principles of the present invention, in accordance with an embodiment thereof, an early formation evaluation tool is provided in which fluid samples may be conveniently collected therein.

In one aspect of the present invention, successive fluid samples are received in respective successive fluid samplers of a tool by alternately increasing and decreasing fluid pressure in a tubular string in which the tool is interconnected. The fluid samples may be received in the samplers either without repositioning the tool in the wellbore, or with the tool being repositioned in the wellbore between sample collections.

In another aspect of the present invention, fluid pressure in the tubular string may also be utilized to sealingly engage one or more packers of the tool with a wellbore. The fluid pressure used to operate the packers may be maintained in the tool while the fluid pressure in the tubular string is altered to operate the samplers.

In yet another aspect of the present invention, the tubular string to which fluid pressure is applied to collect fluid samples in the tool may also be manipulated to pump fluid from a formation into the tool. Thus, various operations of the tool may be conveniently and separately accomplished as desired by merely manipulating or applying fluid pressure to the tubular string.

In still another aspect of the present invention, the tool may include a ratchet mechanism responsive to fluid pressure applied to the tubular string. In one embodiment described herein, a J-slot is used to incrementally displace a piercing member relative to a series of pressure barriers. Fluid pressure applied to the tubular string may also be utilized to cause the member to pierce one of the barriers with which the member is aligned.

In a further aspect of the present invention, the tool includes at least one fluid sampler including an actuator. The actuator is placed in fluid communication with one fluid passage of the tool to thereby cause the sampler to receive a fluid sample therein from another fluid passage of the tool. In one embodiment described herein, the one fluid passage used to operate the actuator is placed in fluid communication with the interior of the tubular string in which the tool is interconnected.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
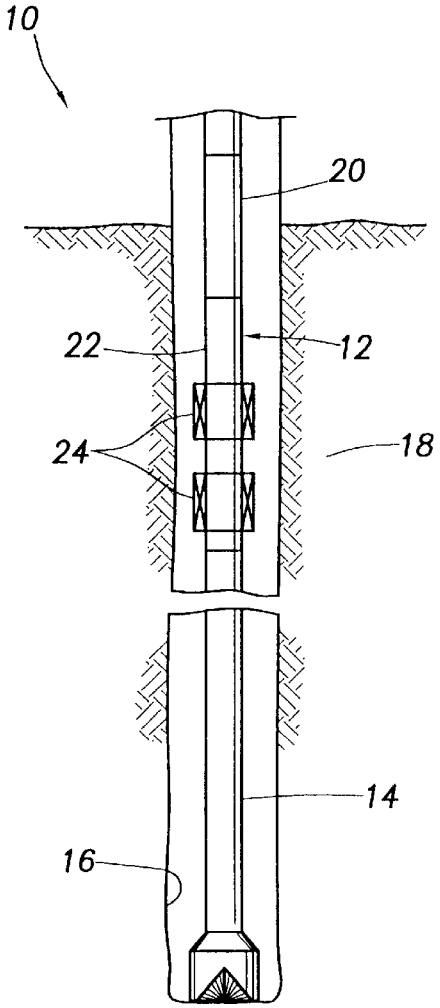
FIG. 1 is a schematic partially cross-sectional view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In the method 10, a formation testing system 12 is interconnected in a tubular string 14, such as a drill string, and is positioned in a wellbore 16. As depicted in FIG. 1, the formation testing system 12 is utilized as a part of the drill string 14 during drilling operations. Preferably, after a formation 18 of interest has been intersected by the wellbore 16, drilling is momentarily halted while the formation testing system 12 is used to evaluate characteristics of the formation. However, it is to be clearly understood that principles of the present invention may be utilized in other methods, for example, after drilling operations have been completed, or wherein the formation testing system 12 is conveyed into the wellbore 16 as a part of another type of tubular string, etc.

The formation testing system 12 is similar in many respects to the formation testing system described in U.S. Pat. No. 5,791,414, the disclosure of is incorporated herein by this reference. However, the present applicant has devised unique manners of adding fluid sampling capability to the formation testing system described in that patent, so that formation fluid samples may be collected in the system. Of course, principles of the present invention may be incorporated into other types of downhole systems, and it is not necessary for the present invention to be used in conjunction with the formation testing system of U.S. Pat. No. 5,791,414.

The formation testing system 12 used in the method 10 as depicted in FIG. 1 includes a valve actuating section, apparatus or tool 20 and a fluid sampling section, apparatus or tool 22. Preferably, the valve actuating section 20 is similar to, or the same as, the valve actuating section described in the incorporated patent. The valve actuating section 20 includes a valve portion operative to selectively permit and prevent flow through a main axial flow passage of the drill string 14 in response to altering a fluid pressure differential between the interior and exterior of the drill string. Such fluid pressure differential changes are preferably caused by changing a rate of circulation of fluid through the drill string 14. When the valve portion closes, the interior of the drill string 14 above the valve portion is placed in fluid communication with an internal inflation fluid passage of the fluid sampling section 22, so that fluid pressure in the drill string above the valve portion may be used to inflate inflatable packers 24 of the fluid sampling section. The packers 24 sealingly engage the wellbore 16, thereby isolating a portion of the formation 18 between the packers from the remainder of the wellbore. Fluid from the formation 18 may then be drawn into the fluid sampling section 22 by manipulating the drill string 14, as described in further detail in the incorporated patent.

Figure 2A:
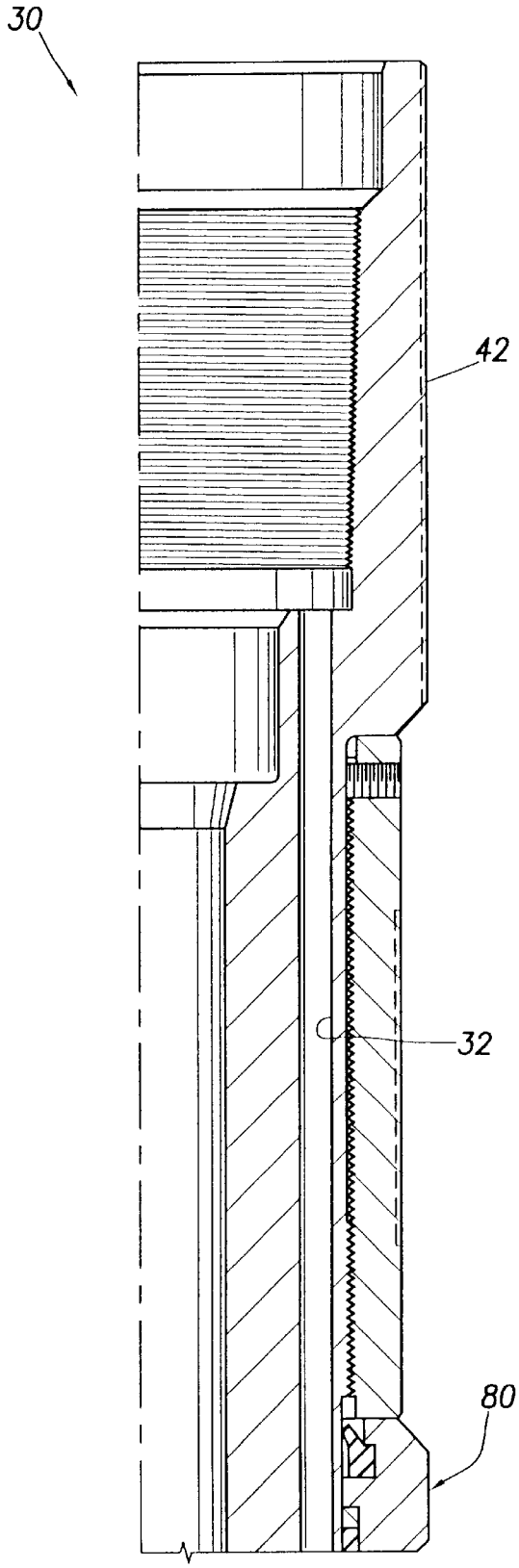
FIGS. 2A–V are quarter-sectional views of successive axial sections of an early formation evaluation tool which may be utilized in the method of FIG. 1.
Figure 2B:
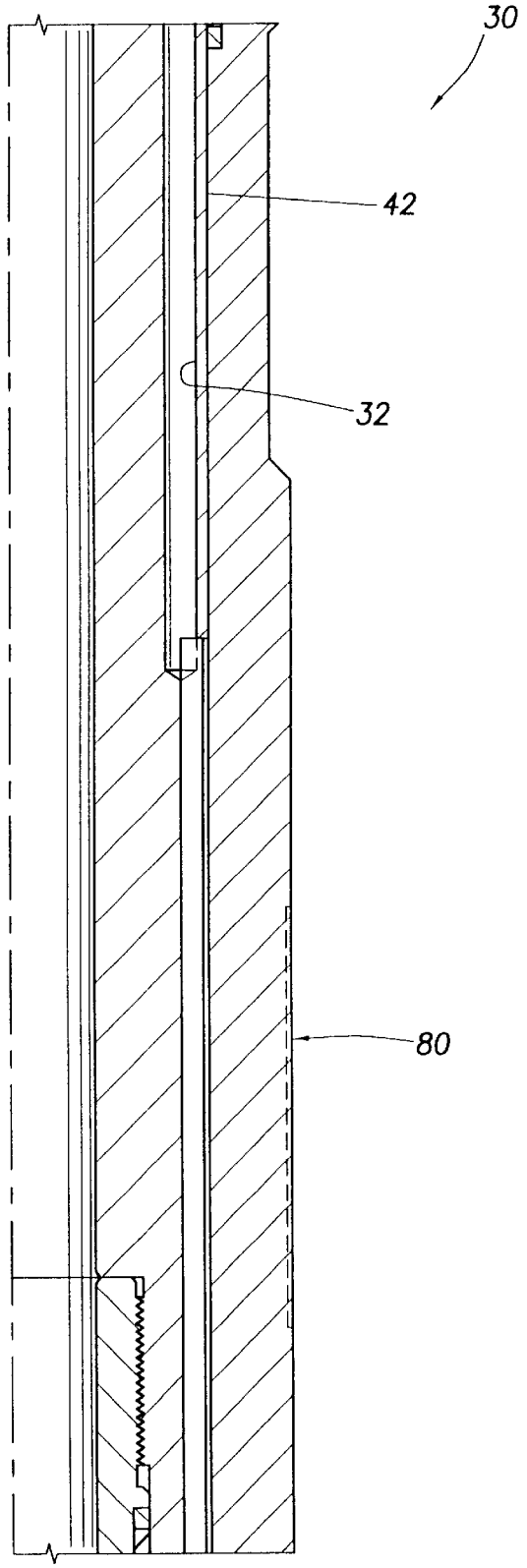
Figure 2C:
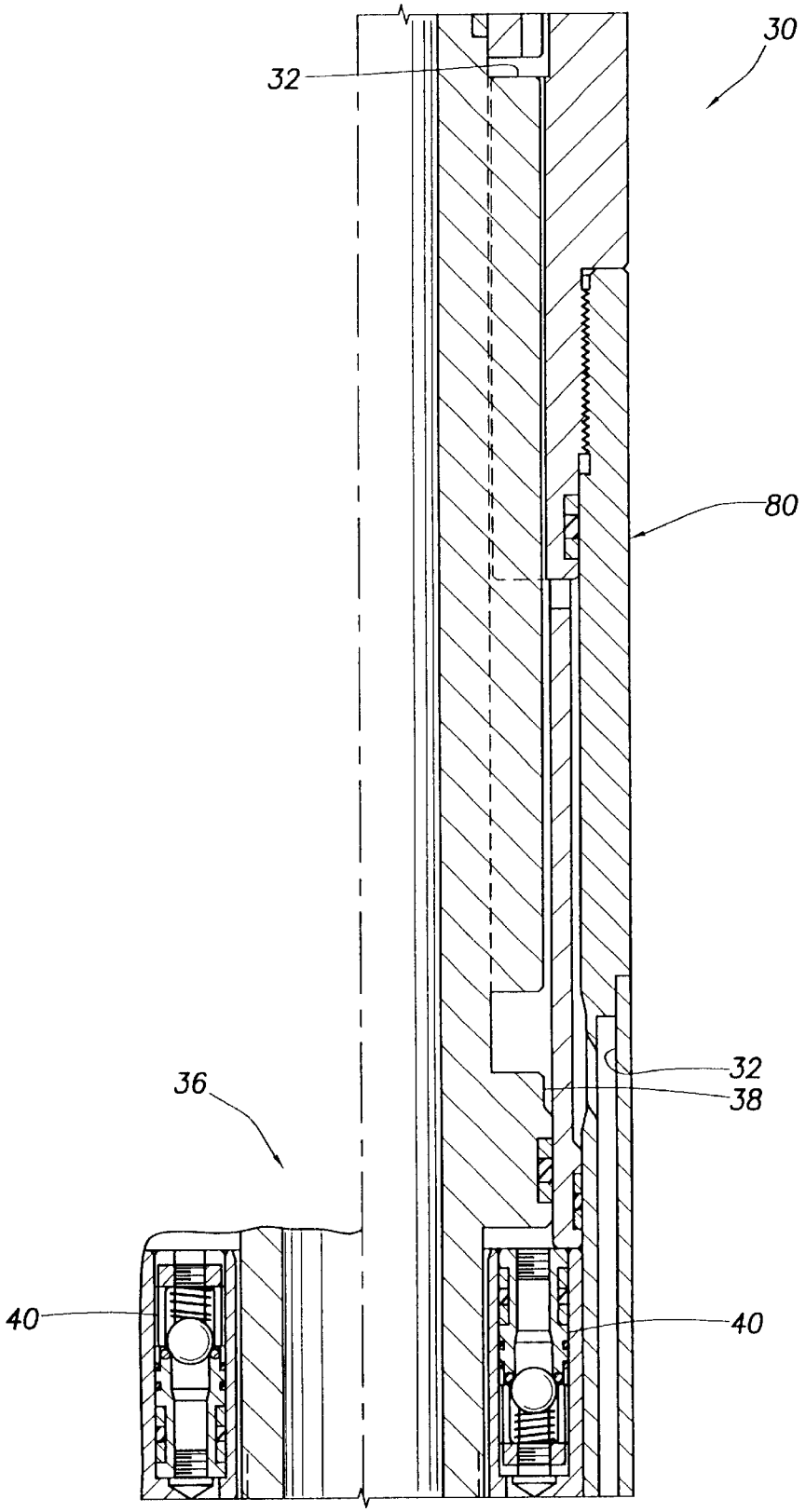
Figure 2D:
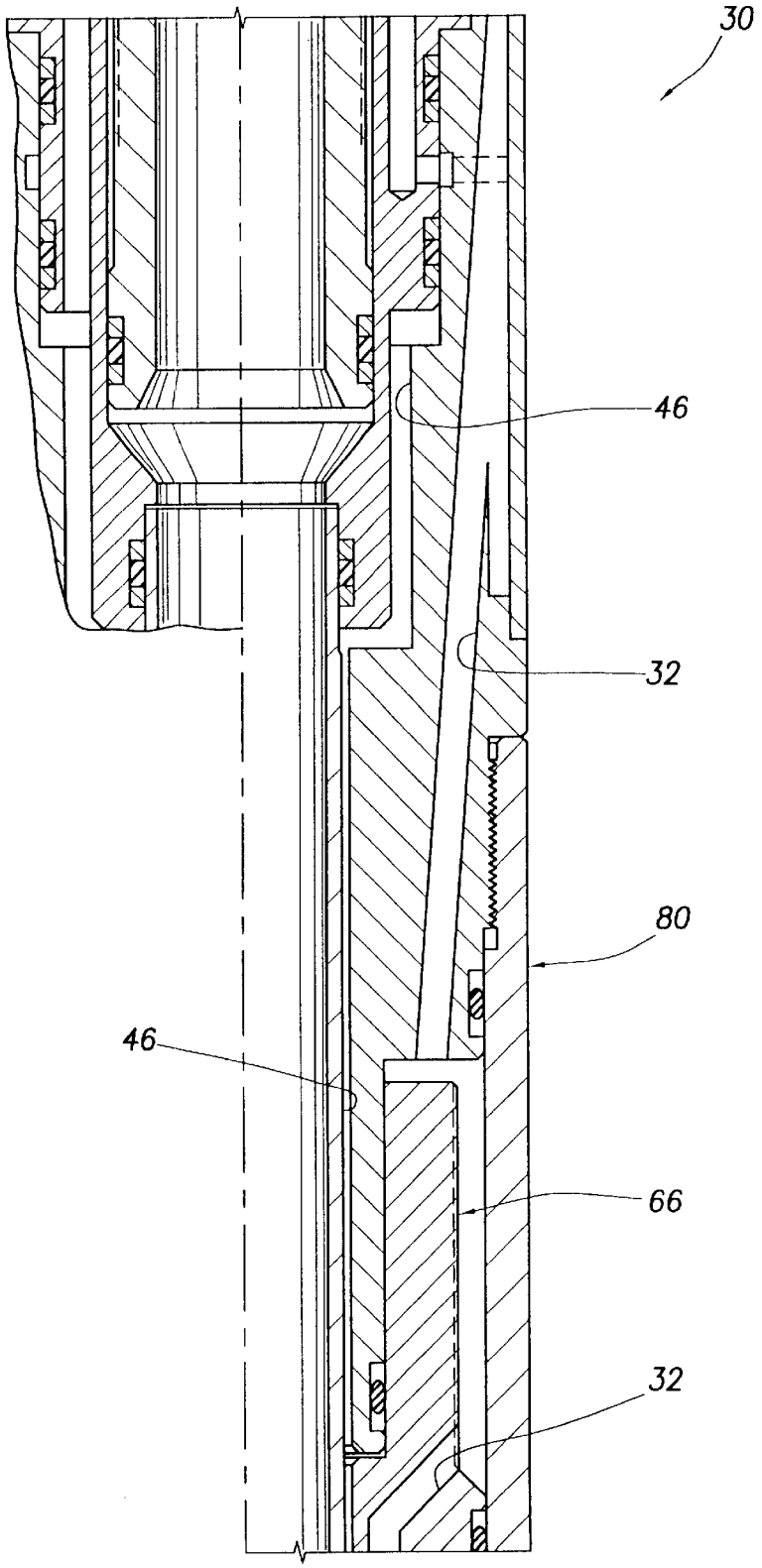
Figure 2E:
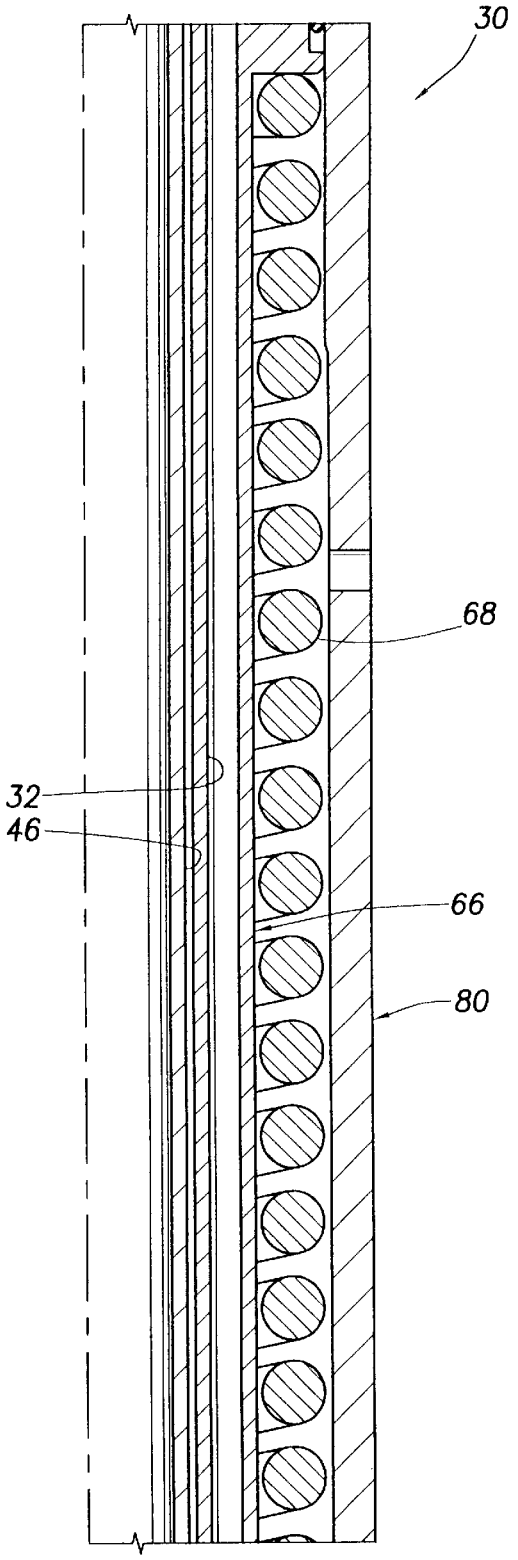
Figure 2F:
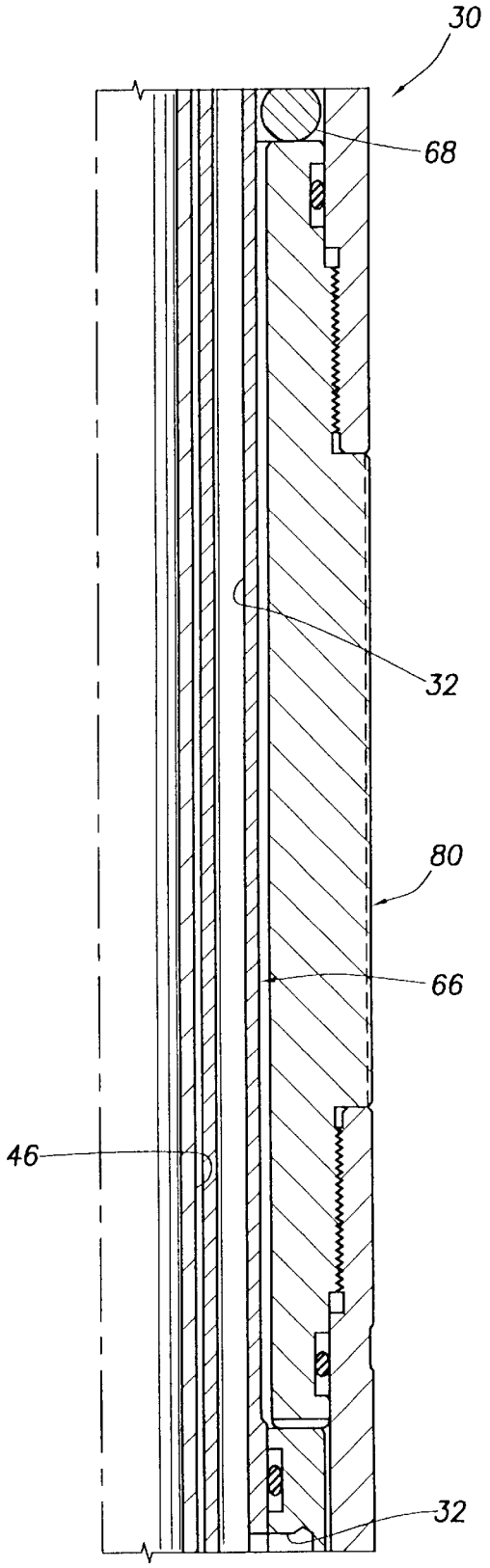
Figure 2G:
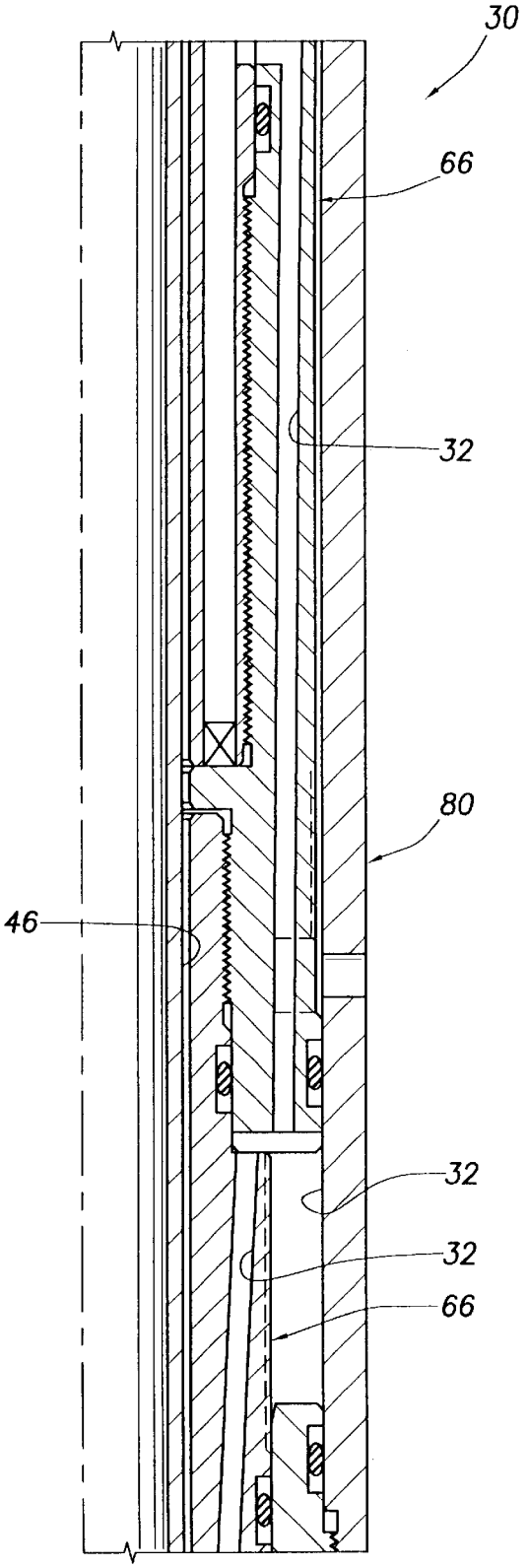
Figure 2H:
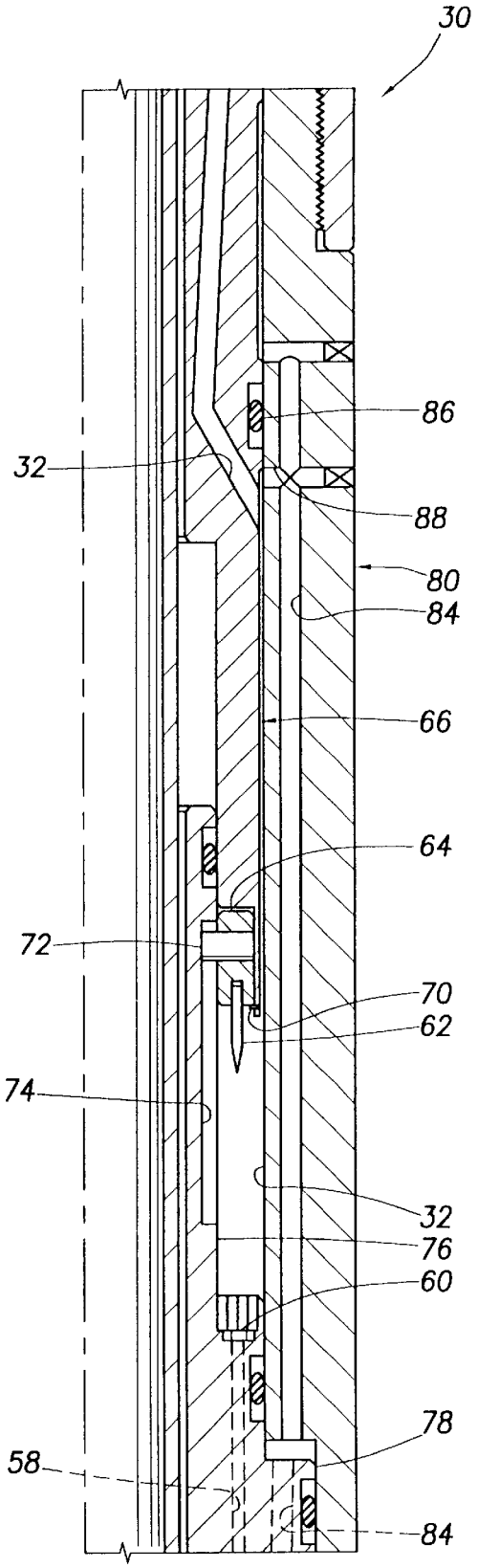
Figure 21:
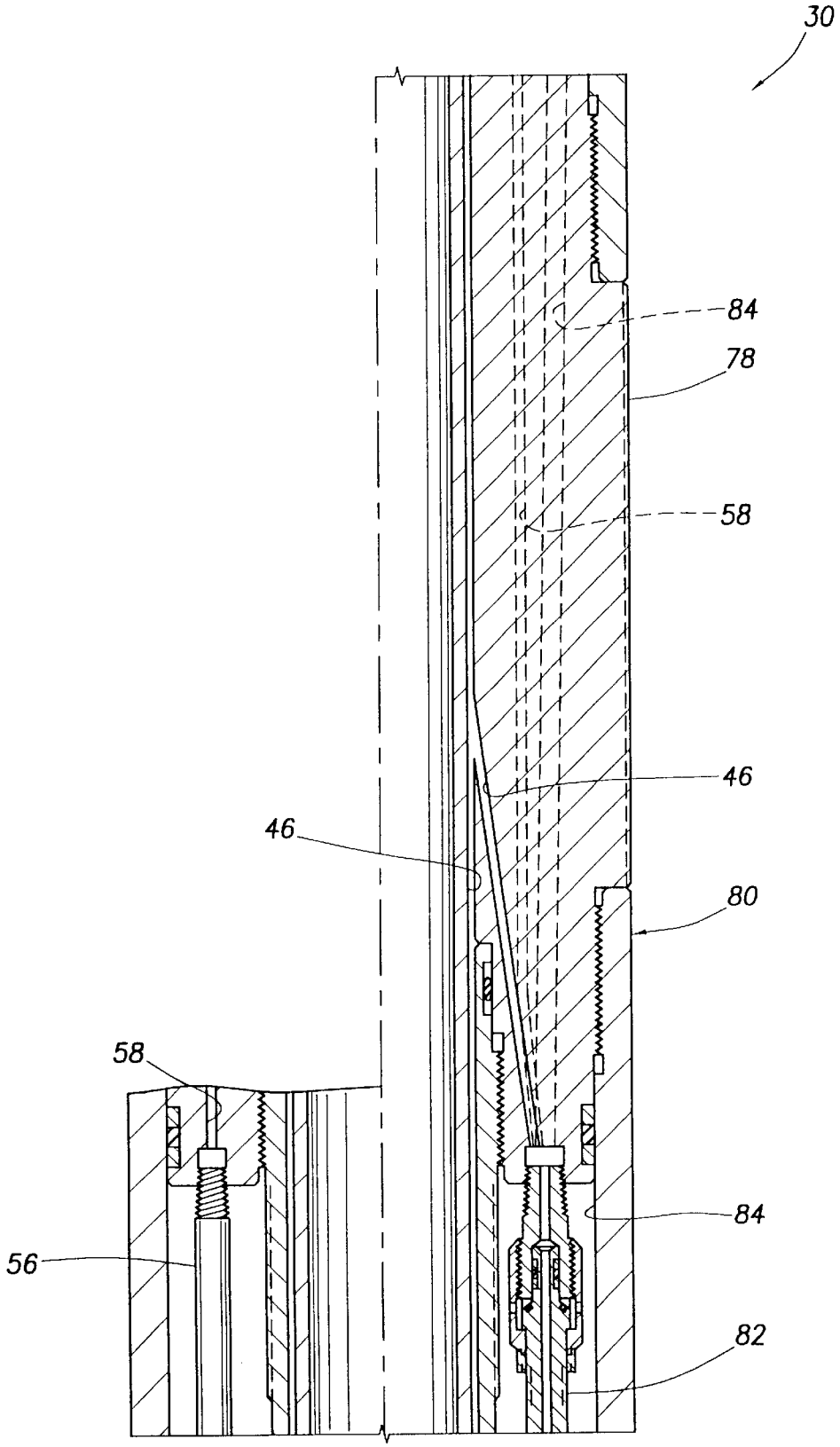
Figure 2J:
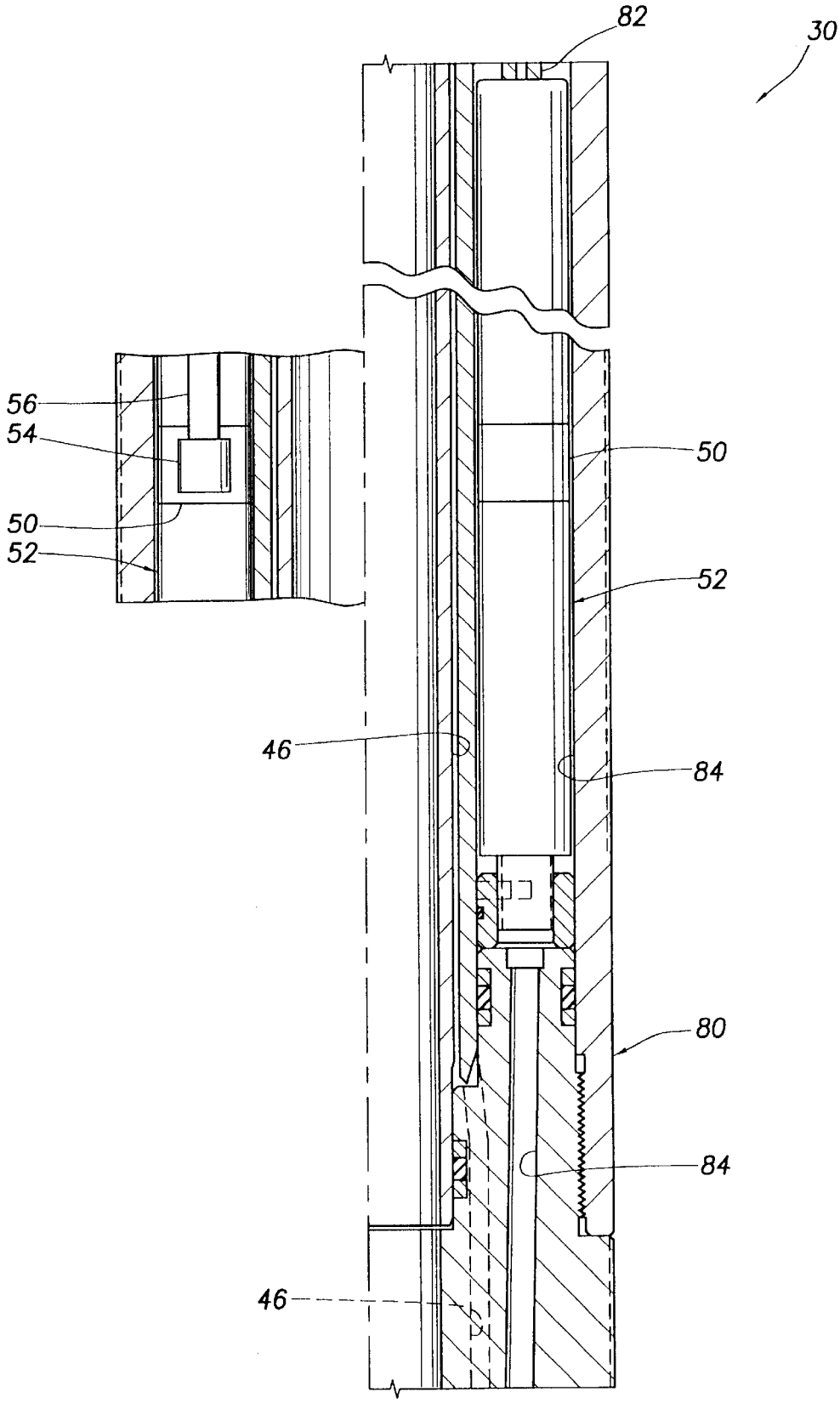
Figure 2K:
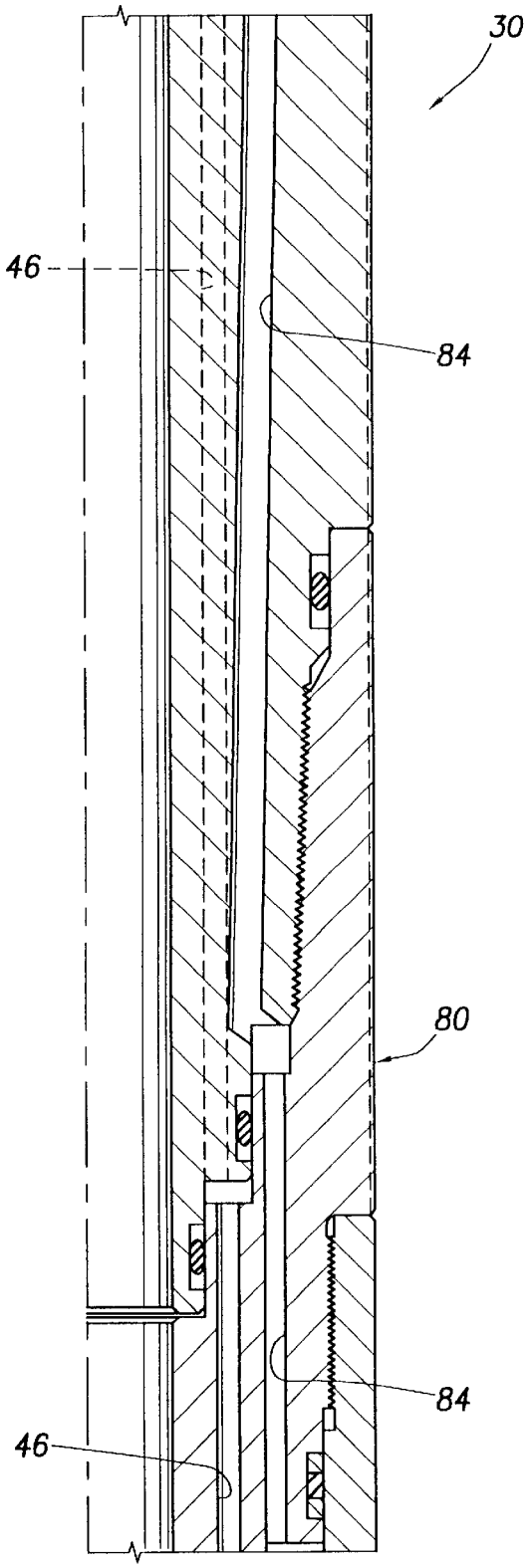
Figure 2L:
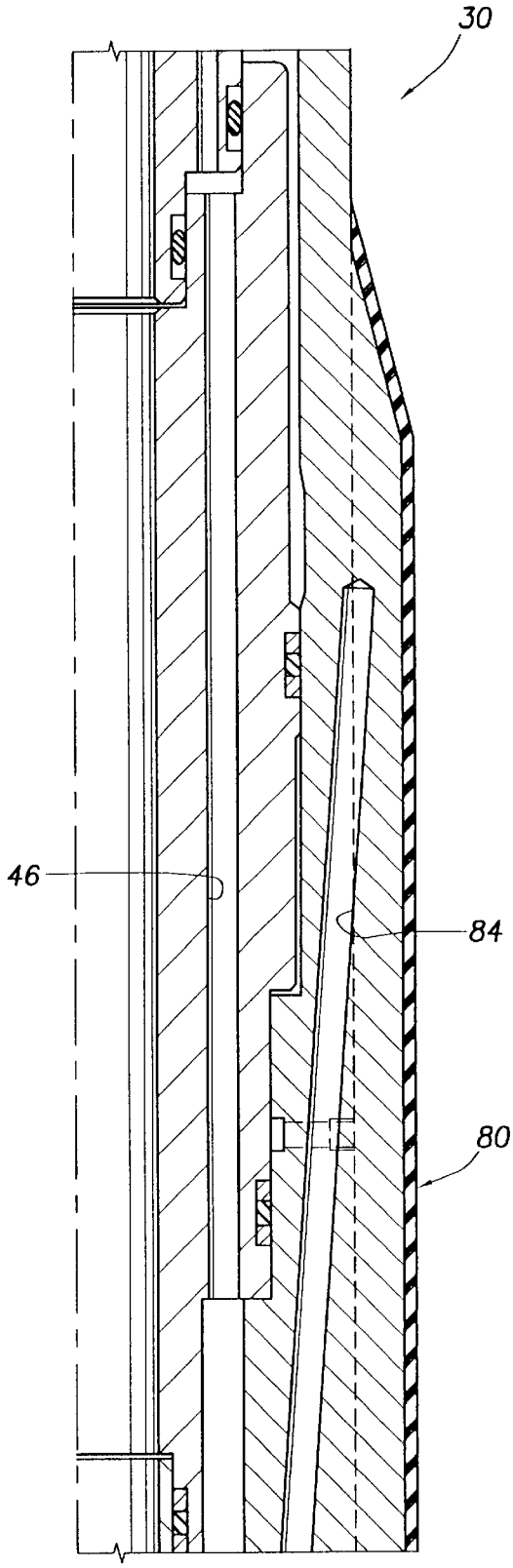
Figure 2M:
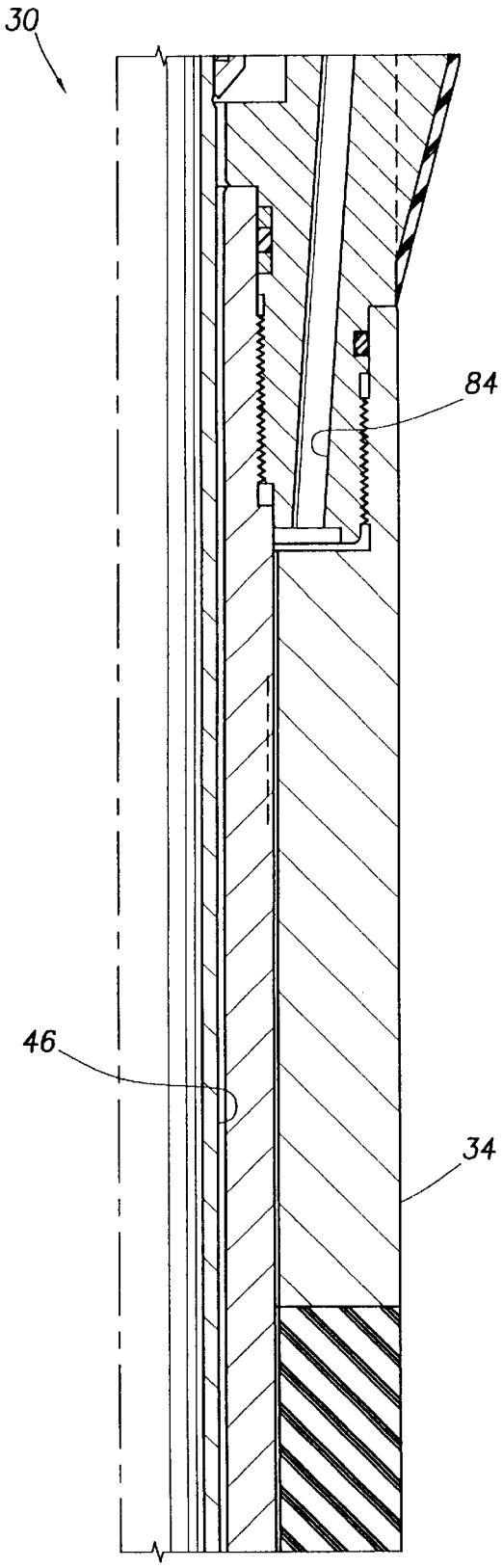
Figure 2N:
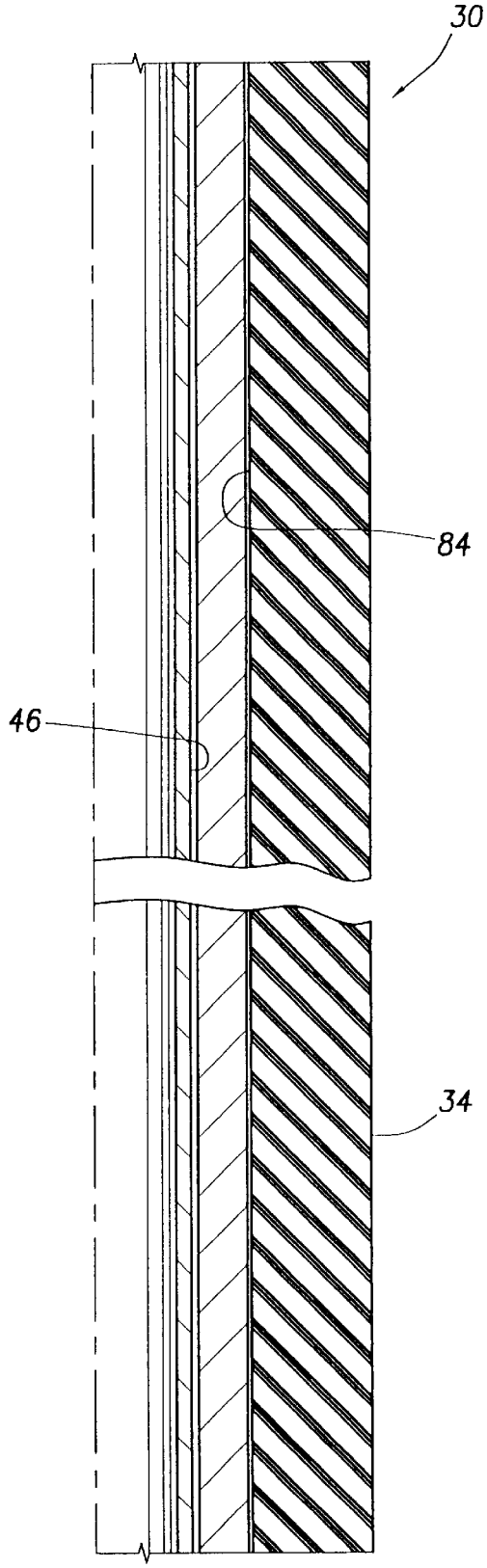
Figure 2O:
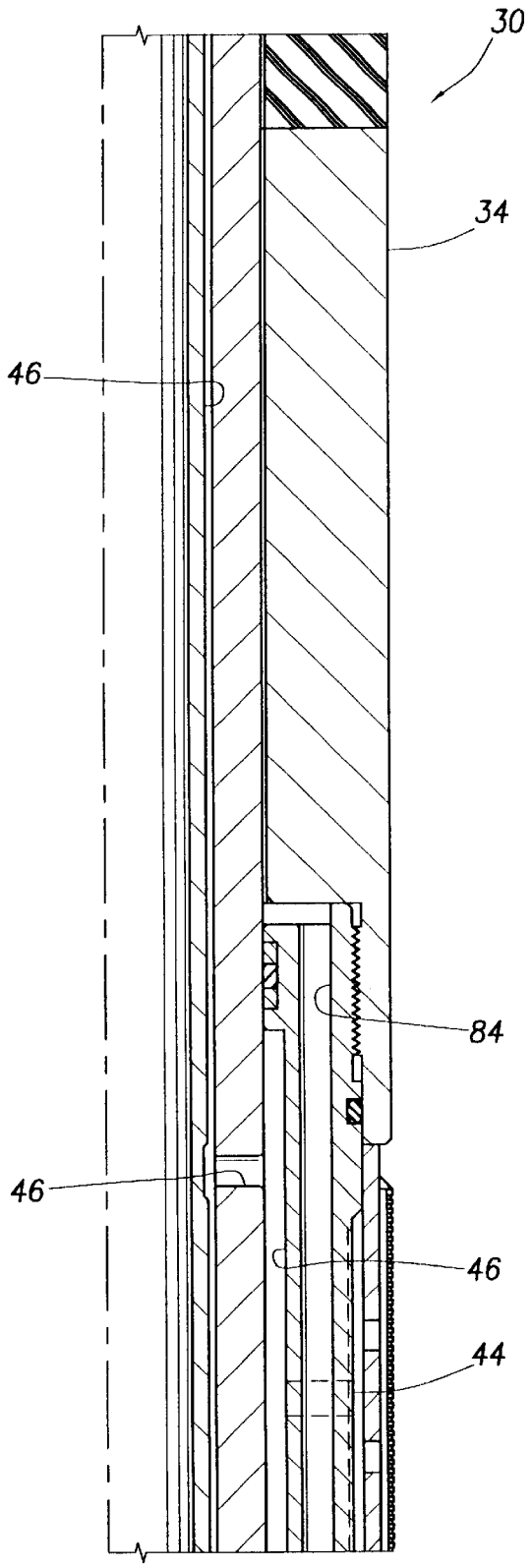
Figure 2P:
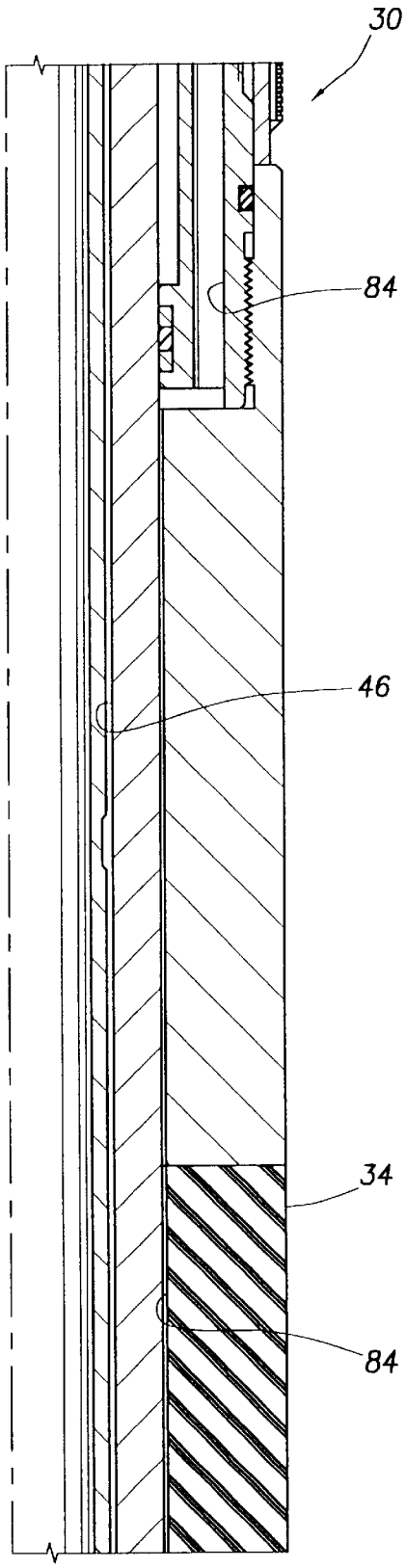
Figure 2Q:
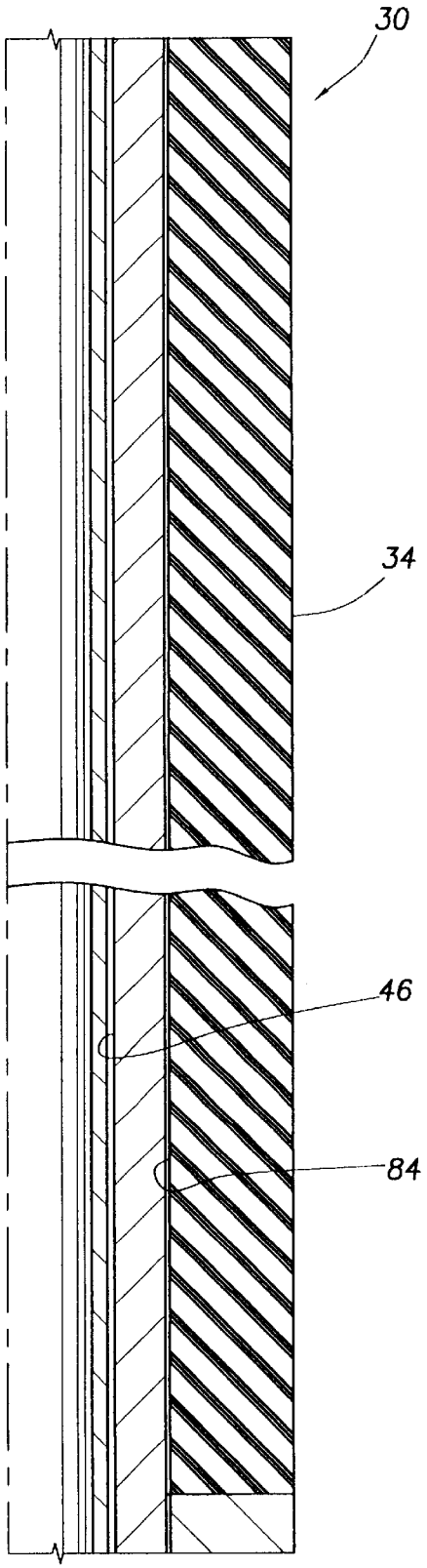
Figure 2R:
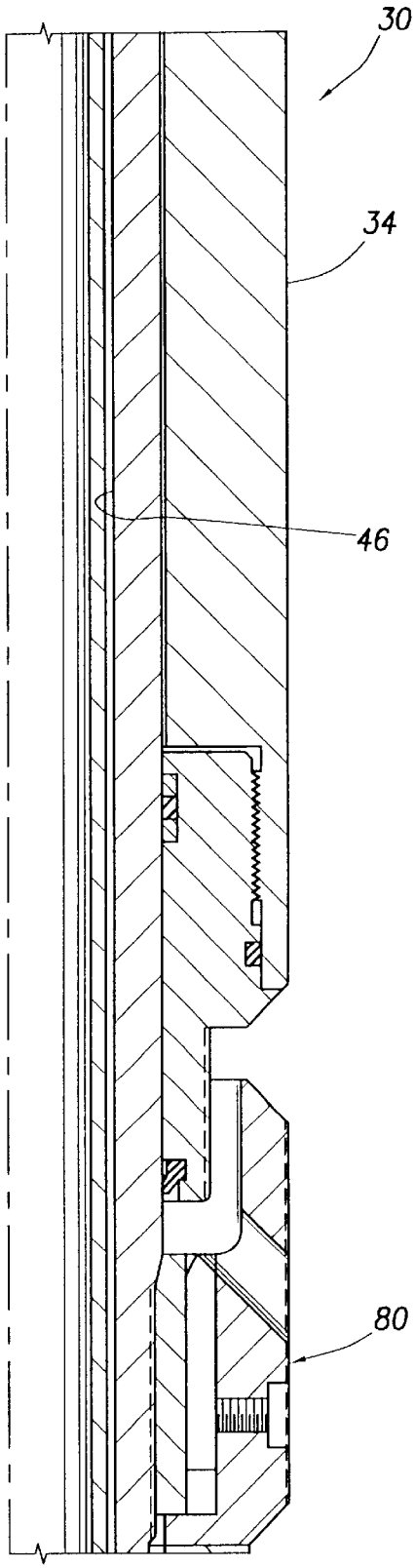
Figure 2S:
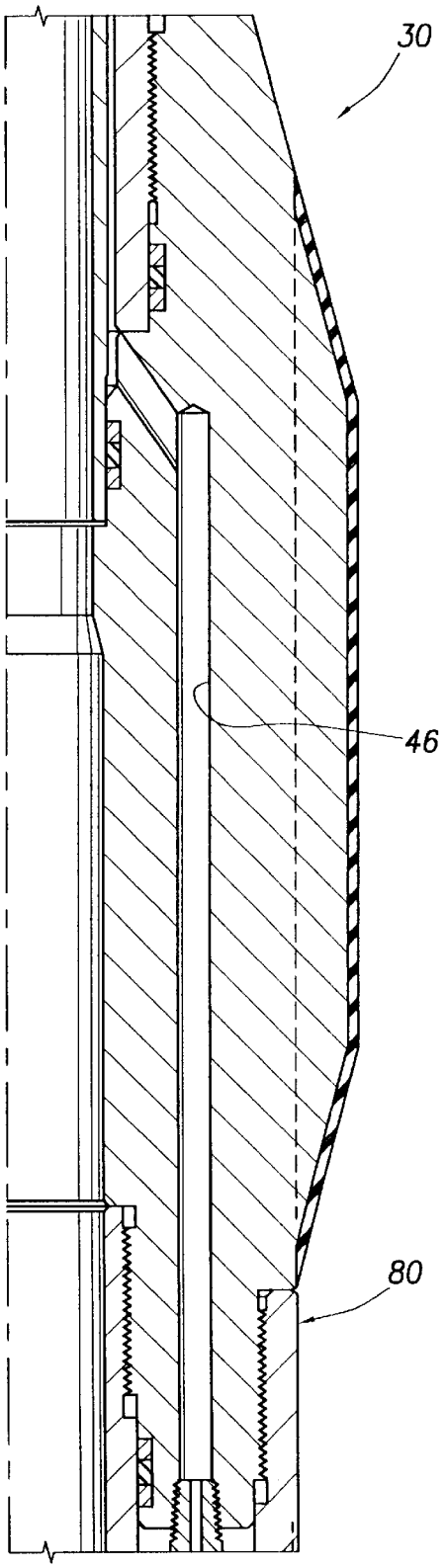
Figure 2T:
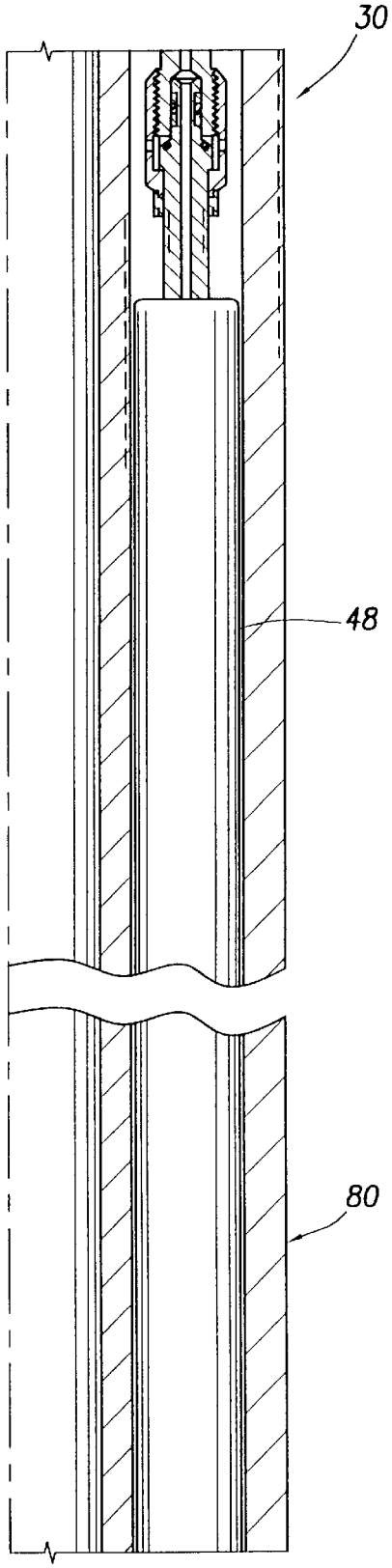
Figure 2U:
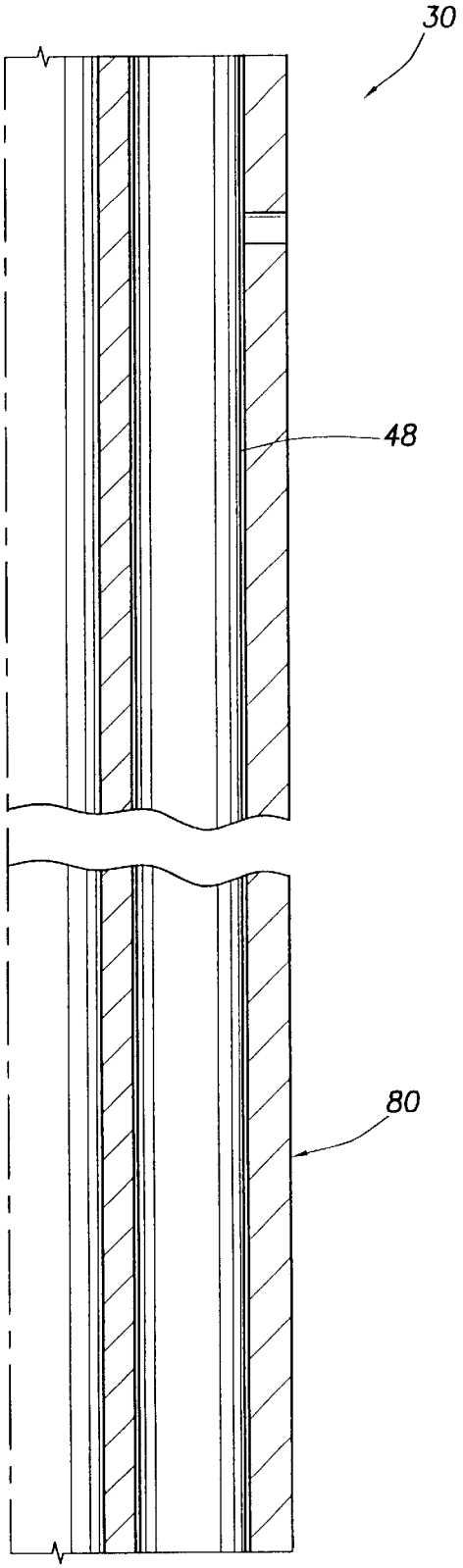
Figure 2V:
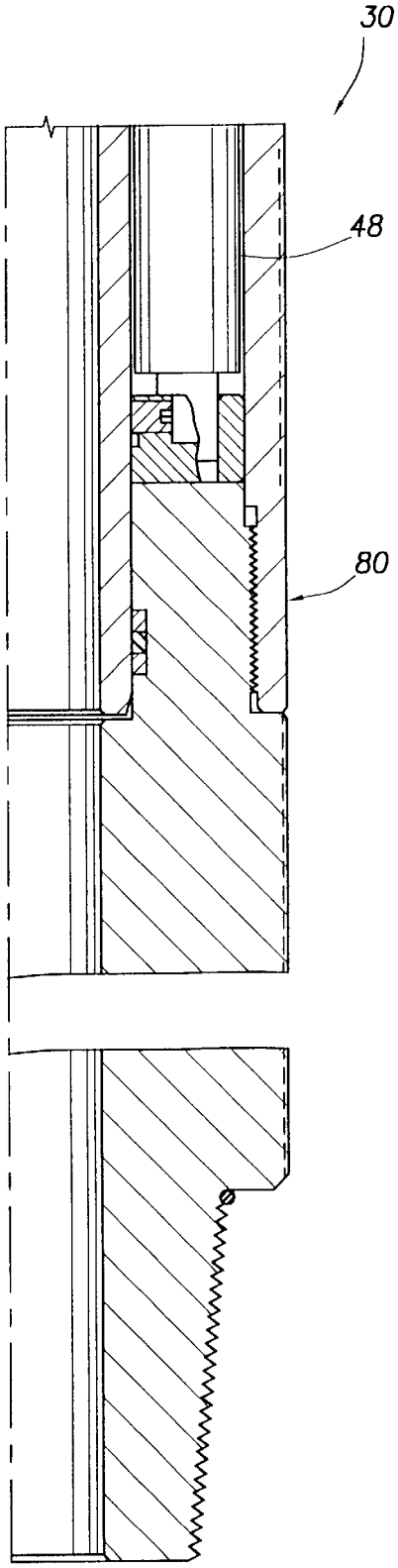

Referring additionally now to FIGS. 2A–V, a fluid sampling apparatus 30 embodying principles of the present invention is representatively illustrated. The apparatus 30 may be used for the fluid sampling section 22 of the fluid sampling system 12 in the method 10, or the apparatus may be used in other systems or methods.

The apparatus 30 is similar in many respects to the fluid sampling section described in the incorporated patent. For example, fluid pressure applied to an internal fluid passage 32 of the apparatus 30 may be used to inflate axially spaced apart packers 34 carried on the apparatus. After the packers 34 have been sealingly engaged with a wellbore, such as the wellbore 16 in the method 10, a pump assembly 36, including a piston 38 and check valves 40, may be operated by stroking the piston axially, such as by raising and lowering the drill string 14, which is interconnected to the piston via an upper connector 42. Such operation of the pump assembly 36 may be used to pump fluid from a formation into a crossover 44 positioned between the packers 34, and thence into another internal fluid passage 46. One or more instruments 48 in communication with the passage 46 may then be used to measure/record pressure drawdown and buildup, temperature, resistivity, etc., or other parameters useful in characterizing the formation and/or the fluid contained in the formation, etc.

However, in one unique aspect of the present invention, fluid pressure in the passage 32 may also be used in operating one or more actuators 50 of corresponding respective one or more fluid samplers 52. The apparatus 30 representatively includes six circumferentially distributed and equally spaced apart samplers 52. Only two of the samplers 52, including one of the corresponding actuators 50, are visible in FIG. 2J, but there may be any number of the samplers.

The samplers 52 are preferably, although not necessarily, of the type described in U.S. application Ser. No. 08/935,867, filed Sep. 23, 1997, the disclosure of which is incorporated herein by this reference. In the sampler described in that application, an actuator of the sampler includes a rupture disc which is broken to actuate the sampler to receive a fluid sample therein. The samplers 52 of the apparatus 30 depicted in FIG. 2J are somewhat modified from the sampler described in the incorporated application, however, in that their actuators 50 do not include the rupture disc. Instead, each actuator 50 is connected via an adapter 54 and conduit 56 to an internal fluid passage 58 of the apparatus 30. For example, if there are six of the samplers 52 in the apparatus 30, then there are correspondingly six of the adapters 54, six of the conduits 56 and six of the passages 58. Thus, when fluid pressure is applied to one of the passages 58, the pressure is transmitted to the corresponding actuator 50, which is thereby operated to cause the corresponding sampler 52 to receive a fluid sample therein.

As used herein, the term "sampler" is used to indicate a container in which a fluid sample may be retained, isolated from contamination, for retrieval and subsequent analysis. As used herein, the term "actuator", when used in conjunction with a sampler, is used to indicate a mechanism or device of the sampler which is operated to cause the sampler to receive a fluid sample therein. It is to be clearly understood that principles of the present invention may be incorporated into apparatus which utilize samplers and actuators other than those described herein.

Fluid pressure is applied successively to the passages 58 by successively breaking corresponding respective frangible pressure barriers 60. Only one of the pressure barriers 60 is shown in FIG. 2H, but it is to be understood that a pressure barrier is preferably associated with each of the passages 58 to initially isolate each of the passages from the passage 32. Note that the passages 58 and pressure barriers 60 are circumferentially distributed and equally spaced apart in the apparatus 30.

As used herein, the term "pressure barrier" is used to indicate any means of selectively permitting and preventing fluid pressure communication therethrough. For example, the pressure barrier 60 may be a pierceable disc or rupture disc as depicted in FIG. 2H, or the pressure barrier may be a valve, etc.

The pressure barriers 60 are opened to fluid pressure communication therethrough by successively piercing them with a penetrator or piercing member 62 attached to a ring 64. The ring 64 is rotatably attached to a piston assembly 66. A circular clip 70 axially retains the ring 64 relative to the piston assembly 66 while permitting rotation of the ring relative to the piston assembly.

Note that the passage 32 extends at least partially through the piston assembly 66 and acts on an upwardly facing differential area of the piston assembly. Fluid pressure in the passage 32 biases the piston assembly 66 axially downward against an upwardly biasing force exerted by a compression spring 68. Thus, when a downwardly directed force on the piston assembly 66 (due to fluid pressure in the passage 32) exceeds the upwardly biasing force exerted on the piston assembly by the spring 68, the piston assembly displaces downward, thereby displacing the penetrator 62 toward one of the barriers 60 with which the penetrator is axially and circumferentially aligned.

A pin 72 is attached to the ring 64 and extends inwardly therefrom. The pin 72 is received in a J-slot profile 74 formed externally on a generally annular-shaped internal portion 76 of an intermediate housing member 78 of an overall outer housing assembly 80. The J-slot profile 74 extends circumferentially about the annular portion 76 and is continuous.

Figure 3:
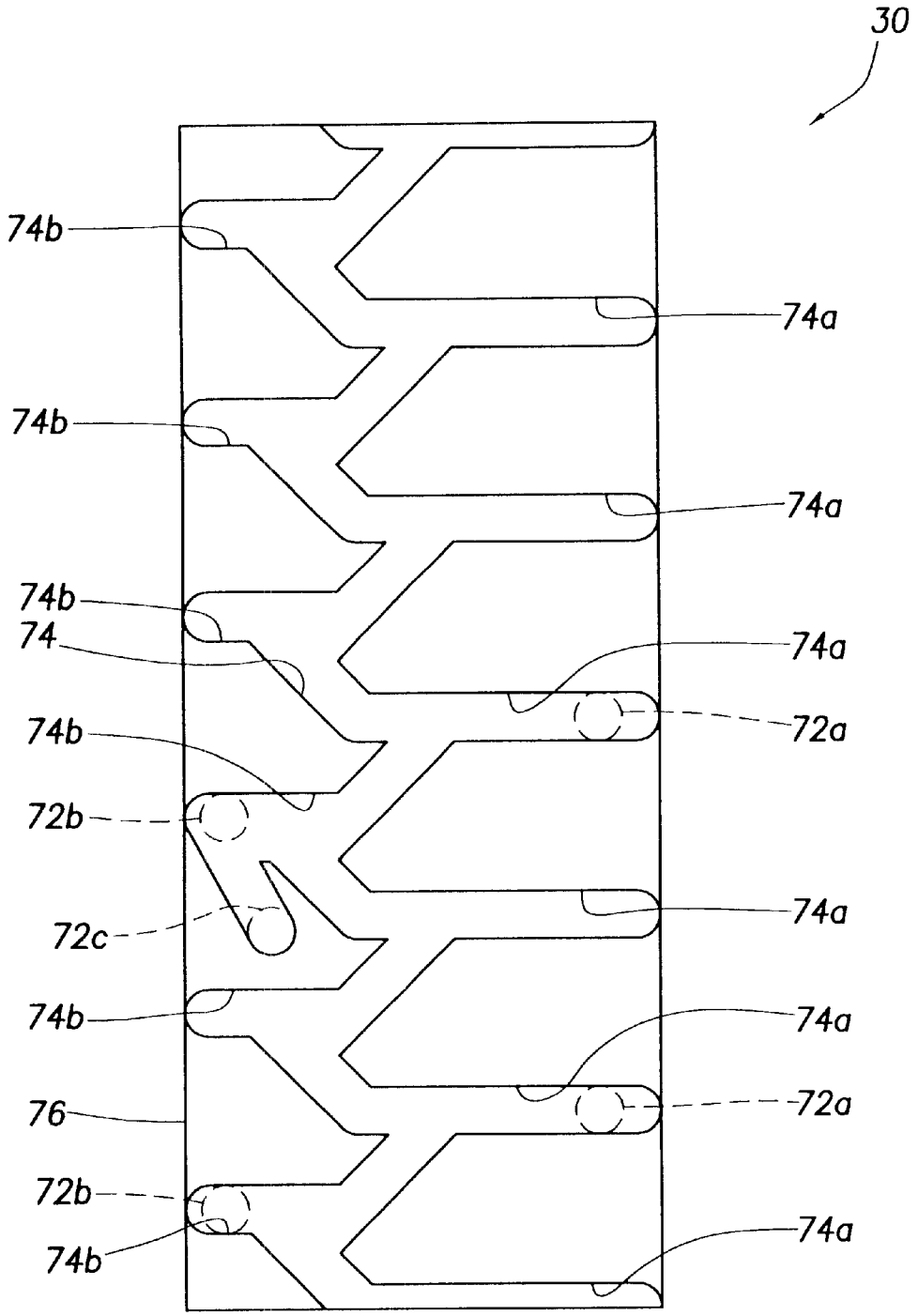
FIG. 3 is an elevational developed view of a J-slot member of the tool of FIGS. 2A–V.

Referring additionally now to FIG. 3, a developed view of the J-slot profile 74 on the portion 76 is representatively illustrated with various positions of the pin 72 therein being shows in dashed lines. J-slot profiles such as the profile 74 are well known to those skilled in the art and, therefore, the manner in which the profile is used to incrementally rotate the ring 64 and thereby align the penetrator 62 with successive ones of the barriers 60 will be only briefly described herein. Those skilled in the art refer to such mechanisms as "ratchet" mechanisms, in which one member is displaced incrementally relative to another member of the mechanism. However, it is to be clearly understood that other types of ratchet mechanisms, and other displacement devices and mechanisms, may be utilized in the apparatus 30, without departing from the principles of the present invention.

The J-slot profile 74 is depicted in FIG. 3 as if it were "unrolled", that is, from a two-dimensional perspective, wherein the direction to the right in FIG. 3 is the downward direction as viewed in FIG. 2H. Thus, when the pin 72 displaces downward due to the piston assembly 66 displacing downward in response to fluid pressure in the passage 32, the pin correspondingly displaces to the right as viewed in FIG. 3. For convenience, axially downwardly elongated portions 74*a* of the profile 74 have been numbered (1, 2, 3, 4, 5 and 6) adjacent the right-hand side of FIG. 3 to indicate the corresponding one of the pressure barriers 60 aligned with each of the portions 74*a*. The number 4 is repeated at the top and bottom of the figure, since the corresponding portion 74*a* is continuous between the top and bottom of the figure.

When the piston assembly 66 is in the position shown in FIGS. 2A–V, the pin 72 is upwardly disposed in the profile 74 in axially upwardly elongated portions 74*b* of the profile. When the piston assembly 66 is downwardly displaced (due to increased fluid pressure in the passage 32 overcoming the upwardly biasing force of the spring 68), the pin 72 displaces downwardly in the profile 74 (to the right in FIG. 3) and eventually enters one of the portions 74*a*. Of course, due to compression of the spring 68, fluid pressure in the passage 32 sufficient to initiate downward displacement of the pin 72 in the profile 74 is thereafter increased further to displace the pin into one of the portions 74*a*. For example, approximately 800 psi in the passage 32 may be sufficient to initiate downward displacement of the pin 72 when it is at a position 72*b* as indicated in FIG. 3, and approximately 1,500 psi may be required to fully downwardly displace the pin to a position 72*a* as indicated in FIG. 3.

Note that the pin 72 rotates when traversing from position 72*b* to position 72*a*. This is seen as an upward displacement of the pin 72 in FIG. 3. Of course, by decreasing the pressure in the passage 32, the pin 72 may be upwardly displaced in the profile 74 from a position 72*a* to a next adjacent position 72*b*, due to the spring 68 upwardly biasing the piston assemble 66. Thus, it will be readily appreciated by one skilled in the art that the pin 72 may be sequentially and incrementally rotated with respect to the profile 74 by alternately increasing and decreasing the pressure in the passage 32. In one embodiment of the apparatus 30, fluid pressure in the passage 32 may be alternated between 1,000 and 1,500 psi to thereby incrementally rotate the pin 72 about the profile 74. Other pressures may be utilized without departing from the principles of the present invention. A position 72*c* of the pin 72 is used when the apparatus 30 is initially assembled.

Referring again to FIG. 2H, the penetrator 62 is circumferentially offset relative to one of the barriers 60 when the piston assembly 66 is in its illustrated upwardly disposed position. When sufficient fluid pressure is applied to the passage 32 to downwardly displace the pin 72 into one of the portions 74*a*, the penetrator 62 will then be circumferentially and axially aligned with one of the barriers 60, due to the fact that the profile 74 rotates the ring 64 as described above and each of the profile portions 74*a* is circumferentially aligned with one of the barriers. Downward displacement of the pin 72 to one of the positions 72*a* results in the penetrator 62 piercing one of the barriers 60 and thereby permitting fluid communication between the passage 32 and a corresponding one of the passages 58.

Therefore, by alternately increasing and decreasing fluid pressure in the passage 32, the penetrator 62 may be sequentially and incrementally aligned with successive ones of the barriers 60, and each of the barriers may be opened by applying sufficient fluid pressure to the passage 32 when the penetrator is aligned with that barrier. Furthermore, since each barrier 60 is associated with a corresponding one of the passages 58 as described above, such altering of the fluid pressure in the passage 32 results in successive operation of the actuators 50 of the samplers 52, thereby causing the samplers to successively receive fluid samples therein.

Referring specifically now to FIGS. 2I & J, it may be seen that each sampler 52 has a conduit 82 providing fluid communication with the passage 46. As described above, the passage 46 is the passage into which fluid is drawn from the formation when the pump assembly 36 is operated. Thus, when one of the samplers 52 is actuated, it receives fluid therein from the passage 46, which passage preferably contains fluid pumped from a portion of a formation isolated between the packers 34 as described above.

Note that the passage 32 is also utilized for inflating the packers 34 as described above. In order to stabilize fluid pressure within the packers 34 after they have been inflated, the apparatus 30 includes a unique feature which isolates an internal fluid passage 84 leading to the packers from the passage 32 while fluid pressure in the passage 32 is alternately increased and decreased to actuate the samplers 52.

Recall that the piston assembly 66 in one embodiment of the apparatus 30 begins to displace downwardly when fluid pressure in the passage 32 reaches approximately 800 psi. Referring specifically now to FIG. 2H, it may be seen that the passage 32 is initially in fluid communication with the passage 84, that is, when the piston assembly 66 is in its upwardly disposed position. However, when fluid pressure in the passage 32 has been increased to approximately 1,000 psi, a seal 86 carried on the piston assembly 66 traverses an opening 88 formerly providing fluid communication between the passages 32, 84. Thus, at approximately 1,000 psi (which pressure, in one embodiment of the apparatus 30, is sufficient to inflate the packers 34 into sealing engagement with a wellbore), the passages 32, 84 are isolated from each other and that fluid pressure is "trapped" in the passage 84, thereby maintaining inflation of the packers at a stable pressure.

When fluid pressure in the passage 32 is again decreased below approximately 1,000 psi, the seal 86 again traverses the opening 88 (albeit in an opposite direction) and thereby permits fluid communication between the passages 32, 84. Thus, the packers 34 may be conveniently deflated when desired by merely decreasing fluid pressure in the passage 32.

In order to fully appreciate the many benefits of the present invention, an exemplary operation of the apparatus 30 is described below. Operation of the apparatus 30 is described as if the apparatus were utilized for the fluid sampling section 22 in the method 10 depicted in FIG. 1. However, it is to be clearly understood that the apparatus 30 may be otherwise utilized and operated, and that other apparatus may be constructed and other methods may be performed, without departing from the principles of the present invention.

The apparatus 30 is interconnected in the drill string 14 as the fluid sampling section 22 of the formation testing system 12. The drill string 14 is conveyed into the wellbore 16 and drilling is commenced, for example, by rotating the drill string and circulating drilling mud therethrough.

When a formation of interest has been intersected, such as the formation 18, drilling is ceased. The drill string 14 is raised or otherwise displaced to position the apparatus 30 opposite the formation 18, so that inflation of the packers 34 will isolate a desired portion of the formation for analysis.

Fluid is circulated through the drill string 14 as described in the incorporated U.S. Pat. No. 5,791,414 to thereby close the valve portion of the valve actuating section 20 and provide fluid communication between the passage 32 of the apparatus 30 and the interior of the drill string above the valve portion. Fluid pressure applied to the drill string 14 at the surface may then be conveniently used to operate the apparatus 30 as described above.

Fluid pressure in the drill string 14 above the valve portion is increased to approximately 1,000 psi. This fluid pressure is transmitted to the passage 32 and results in inflation of the packers 34, thereby sealingly engaging the packers with the wellbore 16 and isolating the desired portion of the formation 18 from the remainder of the wellbore. The 1,000 psi fluid pressure in the passage 32 also results in downward displacement of the piston assembly 66 and isolation of the passage 84 from the passage 32. This traps the 1,000 psi in the packers 34, maintains their inflation at a stable pressure and secures the apparatus 30 and drill string 14 therebelow relative to the wellbore 16.

The drill string 14 above the apparatus 30 is manipulated by alternately raising and lowering it, thereby operating the pump assembly 36 of the apparatus. Fluid is pumped into the apparatus 30, initially from the annular area radially between the apparatus and the wellbore and axially between the packers 34, but eventually from the portion of the formation 18 isolated between the packers. In this manner, fluid is pumped from the formation 18, through the crossover 44 of the apparatus 30 and into the passage 46. The instruments 48 may be utilized to measure/record parameters such as fluid pressure, resistivity, etc. of the fluid in the passage 46, internal and/or external to the apparatus 30, etc. as described above and in the incorporated patent.

Fluid pressure in the passage 32 is then further increased to approximately 1,500 psi. This increase in fluid pressure further downwardly displaces the piston assembly 66, thereby rotating the ring 64 and causing the penetrator 62 to become circumferentially and axially aligned with one of the barriers 60. Such further downward displacement of the piston assembly 66 also causes the penetrator 62 to pierce the barrier with which it is aligned.

When the barrier 60 is pierced, fluid communication is permitted between the passage 32 and a corresponding one of the passages 58. Fluid pressure in the passage 32 is thus communicated via the passage 58 to a corresponding one of the conduits 56 and to a corresponding one of the actuators 50. Fluid pressure communicated to the actuator 50 causes a corresponding one of the samplers 52 to receive a fluid sample therein from the passage 46 via a corresponding one of the conduits 82.

If it is desired to collect additional fluid samples from the same portion of the formation 18, fluid pressure in the passage 32 may be decreased to approximately 1,000 psi and then increased again to approximately 1,500 psi. This causes the piston assembly 66 to displace upwardly and then downwardly, thereby rotating the ring 64, aligning the penetrator 62 smith the next successive barrier 60 and downwardly displacing the penetrator to pierce the barrier. Upon piercing of the barrier 60, another fluid sample is collected in another corresponding one of the samplers 52 from the passage 46. Between successive fluid sample collections, the drill string 14 above the apparatus 30 may be raised and lowered as desired to pump further fluid from the formation 18 into the passage 46.

If it is desired to collect additional fluid samples from another portion of the formation 18, or from another formation intersected by the wellbore 16, the packers 34 may be deflated by decreasing fluid pressure in the passage 32 and the apparatus 30 may be repositioned in the wellbore. When fluid pressure in the passage 32 has been decreased below approximately 1,000 psi, fluid communication is again permitted between the passages 32, 84. Fluid pressure in the packers 34 may then be bled off through the passage 32 to the drill string 14 above the valve portion of the valve actuating section 20. The apparatus 30 is repositioned as desired and fluid pressure in the passage 32 is again increased to approximately 1,000 psi to inflate the packers 34. The pump assembly 36 is operated to pump fluid from the formation into the passage 46 and fluid pressure in the passage 32 is again increased to approximately 1,500 psi to cause another of the samplers 52 to receive a fluid sample therein from the passage 46.

Once the desired fluid samples are collected, fluid pressure in the passage 32 is relieved, thereby deflating the packers 34 as described above. The valve portion of the valve actuating section 20 is then opened as described in the incorporated patent and drilling may commence, or the apparatus 30 may be retrieved from the well for analysis of the fluid sample(s) contained therein. If, instead of retrieving the apparatus 30 from the well, further drilling is performed and another formation of interest or portion thereof is intersected by the wellbore 16, the apparatus may again be operated to collect further fluid samples as described above.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A formation fluid sampling system, comprising:

a tubular string positioned in a wellbore, the tubular string including a fluid sampling apparatus, and the apparatus including at least one fluid sampler having an actuator, the actuator being operative to admit fluid into the sampler in response to fluid pressure applied to the tubular string.

2. The sampling system according to claim 1, wherein the apparatus further includes a plurality of the fluid samplers, the actuators of the samplers being successively operated in response to respective successive fluid pressures applied to the tubular string.

3. The sampling system according to claim 2, wherein the apparatus further includes a ratchet mechanism, the ratchet mechanism displacing incrementally in response to the respective successive fluid pressures applied to the tublar string.

4. The sampling system according to claim 3, wherein the ratchet mechanism includes a J-slot member, the J-slot member displacing relative to the sampler actuators in response to the respective successive fluid pressures applied to the tubular string.

5. The sampling system according to claim 4, wherein the ratchet mechanism further includes a piercing member, the piercing member being displaced by the J-slot member in response to the respective successive fluid pressures applied to the tubular string.

6. The sampling system according to claim 1, wherein the apparatus further includes at least one inflatable packer, the inflatable packer being inflatable in response to fluid pressure applied to the tubular string.

7. The sampling system according to claim 6, wherein the tubular string further includes a valve, the valve selectively permitting and preventing fluid flow through the tubular string in response to fluid pressure applied to the tubular string.

8. A fluid sampling apparatus, comprising:

a first internal fluid passage;

a packer in communication with the first fluid passage when fluid pressure in the first fluid passage is below a predetermined level, and the packer being isolated from fluid communication with the first fluid passage when fluid pressure in the first fluid passage is above a predetermined level; and a fluid sampler including an actuator, the actuator being placed in fluid communication with the first fluid passage, thereby admitting fluid into the sampler, when fluid pressure in the first fluid passage is above the predetermined level.

9. The apparatus according to claim 8, wherein the actuator admits fluid from a second internal fluid passage of the apparatus into the sampler when fluid pressure in the first fluid passage is above the predetermined level.

10. The apparatus according to claim 8, further comprising a pressure barrier isolating the actuator from fluid communication with the first fluid passage.

11. The apparatus according to claim 10, wherein the pressure barrier is opened to thereby permit fluid communication between the actuator and the first fluid passage when fluid pressure in the first fluid passage is above the predetermined level.

12. A formation fluid sampling system, comprising:

a tubular string positioned in a wellbore and extending along an axis; and fluid sampling apparatus carried by the tubular string and including:

a spaced apart plurality of fluid samplers, a plurality of actuation structures respectively associated with the fluid samplers, each actuation structure being contactable to actuate its associated fluid sampler, and a contacting structure movable into actuating contact with successive ones of the actuating structures in response to predetermined fluid pressure changes in the tubular string.

13. The system according to claim 12, wherein the actuation structures are pierceable pressure barriers, and the contacting structure is operable to successively pierce the pressure barriers.

14. The system according to claim 12, wherein the contacting structure is translatable parallel to and rotatable around the axis in response to the predetermined fluid pressure changes in the tubular string.

15. The system according to claim 12, wherein the fluid samplers are circumferentially spaced apart around the axis.

16. The system according to claim 12, wherein the contacting structure includes a piercing member.

17. The system according to claim 16, wherein the contacting structure further includes an annular member circumscribing the axis, the piercing member extending generally transversely to a side of the annular member.

18. The system according to claim 12, wherein the fluid sampling structure further includes a J-slot structure to which the contacting structure is operatively connected.

19. The system according to claim 12, wherein the system further includes an inflatable packer, the inflatable packer being inflatable in response to fluid pressure applied to the tubular string.

20. The system according to claim 19, wherein the system further includes a valve, the valve selectively permitting and preventing fluid flow through the tubular string in response to fluid pressure applied to the tubular string.

21. A formation fluid sampling system, comprising:

a tubular string positioned in a wellbore and extending along an axis; and fluid sampling apparatus carried by the tubular string and including:

a plurality of fluid samplers circumferentially spaced apart around the axis, a plurality of pressure barriers respectively associated with the fluid samplers, each pressure barrier being pierceable to actuate its associated fluid sampler, and a piercing member movable into piercing contact with successive ones of the pressure barriers in response to predetermined fluid pressure changes in the tubular string.

22. The system according to claim 21, wherein the piercing member is translatable parallel to and rotatable around the axis in response to the predetermined pressure changes in the tubular string.

23. The system according to claim 21, further comprising an annular member circumscribing the axis and being translatable parallel to and rotatable around the axis, the piercing member being transversely secured to a side of the annular member and extending generally parallel to the axis.

24. The system according to claim 23, further comprising a J-slot structure, the annular member being operably coupled to the J-slot structure.

25. The system according to claim 21, wherein the system further includes an inflatable packer, the inflatable packer being inflatable in response to fluid pressure applied to the tubular string.

26. The system according to claim 25, wherein the system further includes a valve, the valve selectively permitting and preventing fluid flow through the tubular string in response to fluid pressure applied to the tubular string.

* * * * *